US009120211B2

(12) United States Patent
Huang

(10) Patent No.: US 9,120,211 B2
(45) Date of Patent: Sep. 1, 2015

(54) RATCHET WRENCH CAPABLE OF BEING OPERATED THROUGH RELATIVELY SMALLER MINIMUM SWING ANGLE ACTION

(71) Applicant: New Way Tools Co., Ltd., Taichung (TW)

(72) Inventor: Ping-Wen Huang, Taichung (TW)

(73) Assignee: New Way Tools Co., Ltd., Taichung (TW)

( * ) Notice: Subject to any disclaimer, the term of this patent is extended or adjusted under 35 U.S.C. 154(b) by 276 days.

(21) Appl. No.: 13/744,490

(22) Filed: Jan. 18, 2013

(65) Prior Publication Data

US 2013/0269488 A1 Oct. 17, 2013

(30) Foreign Application Priority Data

Apr. 13, 2012 (TW) ..... 101113215 A

(51) Int. Cl.
*B25B 13/46* (2006.01)
*B25B 13/48* (2006.01)

(52) U.S. Cl.
CPC ..... *B25B 13/463* (2013.01); *B25B 13/481* (2013.01)

(58) Field of Classification Search
CPC ..... B25B 13/46; B25B 13/463; B25B 13/481
USPC ..... 81/60–63.2
See application file for complete search history.

(56) References Cited

U.S. PATENT DOCUMENTS

| | | | | |
|---|---|---|---|---|
| 2,978,081 | A * | 4/1961 | Lundin | 81/63 |
| 5,782,147 | A * | 7/1998 | Chaconas et al. | 81/63.1 |
| 8,104,381 | B1 * | 1/2012 | Chen | 81/63.2 |
| 8,272,297 | B1 * | 9/2012 | Chen | 81/60 |

FOREIGN PATENT DOCUMENTS

| | | | |
|---|---|---|---|
| TW | 391329 | U | 5/2000 |
| TW | 200407216 | A | 5/2004 |
| TW | M423025 | U | 2/2012 |

* cited by examiner

*Primary Examiner* — Hadi Shakeri
(74) *Attorney, Agent, or Firm* — Alan D. Kamrath; Kamrath IP Lawfirm, P.A.

(57) ABSTRACT

A ratchet wrench includes a head. A gear wheel, a first pawl, and a second pawl are disposed in a chamber defined in the head. The gear wheel has an outer periphery thereof including a plurality of teeth extended circumferentially outwardly therefrom. The first and second pawls each include a lateral side thereof including third and fourth plurality of teeth respectively extended outwardly therefrom. The first and second pawls are disposed one above the other. The first and second pawls are respectively biased by first and second biasing mechanisms. The first and second pawls are alternatively engaged with the gear wheel when it is operably turned.

10 Claims, 18 Drawing Sheets

RATCHET WRENCH CAPABLE OF BEING OPERATED THROUGH RELATIVELY SMALLER MINIMUM SWING ANGLE ACTION

BACKGROUND OF THE INVENTION

1. Field of the Invention

The present invention relates to a ratchet wrench and, in particular, to a ratchet wrench which better withstands torque transmission and is capable of being operated through a relatively smaller minimum swing angle action.

2. Description of the Related Art

U.S. Pat. No. 8,272,297 shows a wrench including a pawl and a gear wheel, and designs of the pawl and the gear wheel determine the minimum swing angle that the wrench can be turned to wrench an object. The pawl includes a side thereof including a plurality of teeth. The gear wheel is rotatable with respect to an axis and includes an annular outer periphery including a plurality of teeth. The teeth of the pawl is clutched with a portion of the plurality of teeth of the gear wheel and the gear wheel is prevented from rotation when the object is turned by the wrench. The gear wheel is rotated relative to the pawl and includes the teeth movably engaging with the teeth of the pawl when the wrench is turned relative to the object. Generally, if the wrench is a compact wrench, the teeth of the pawl and the gear wheel are manufactured with relatively small shapes in order to fit into the compact wrench. However, the compact wrench can not withstand large torque transmission.

The present invention is, therefore, intended to obviate or at least alleviate the problems encountered in the prior art.

SUMMARY OF THE INVENTION

According to the present invention, a ratchet wrench includes a head. A gear wheel, a first pawl, and a second pawl are disposed in a chamber defined in the head. The gear wheel has an outer periphery thereof including a plurality of teeth extended circumferentially outwardly therefrom. The first and second pawls each include a lateral side thereof including a plurality of teeth extended outwardly therefrom. The first and second pawls are disposed one above the other. The first and second pawls are respectively biased by first and second biasing mechanisms. The first and second pawls are alternatively engaged with the gear wheel when it is operably turned.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is therefore an objective of the present invention to provide a ratchet wrench which better withstands torque transmission and is capable of being operated through a relatively smaller minimum swing angle action.

Other objectives, advantages, and new features of the present invention will become apparent from the following detailed description of the invention when considered in conjunction with the accompanied drawings.

DETAILED DESCRIPTION OF THE INVENTION

Figure 1:
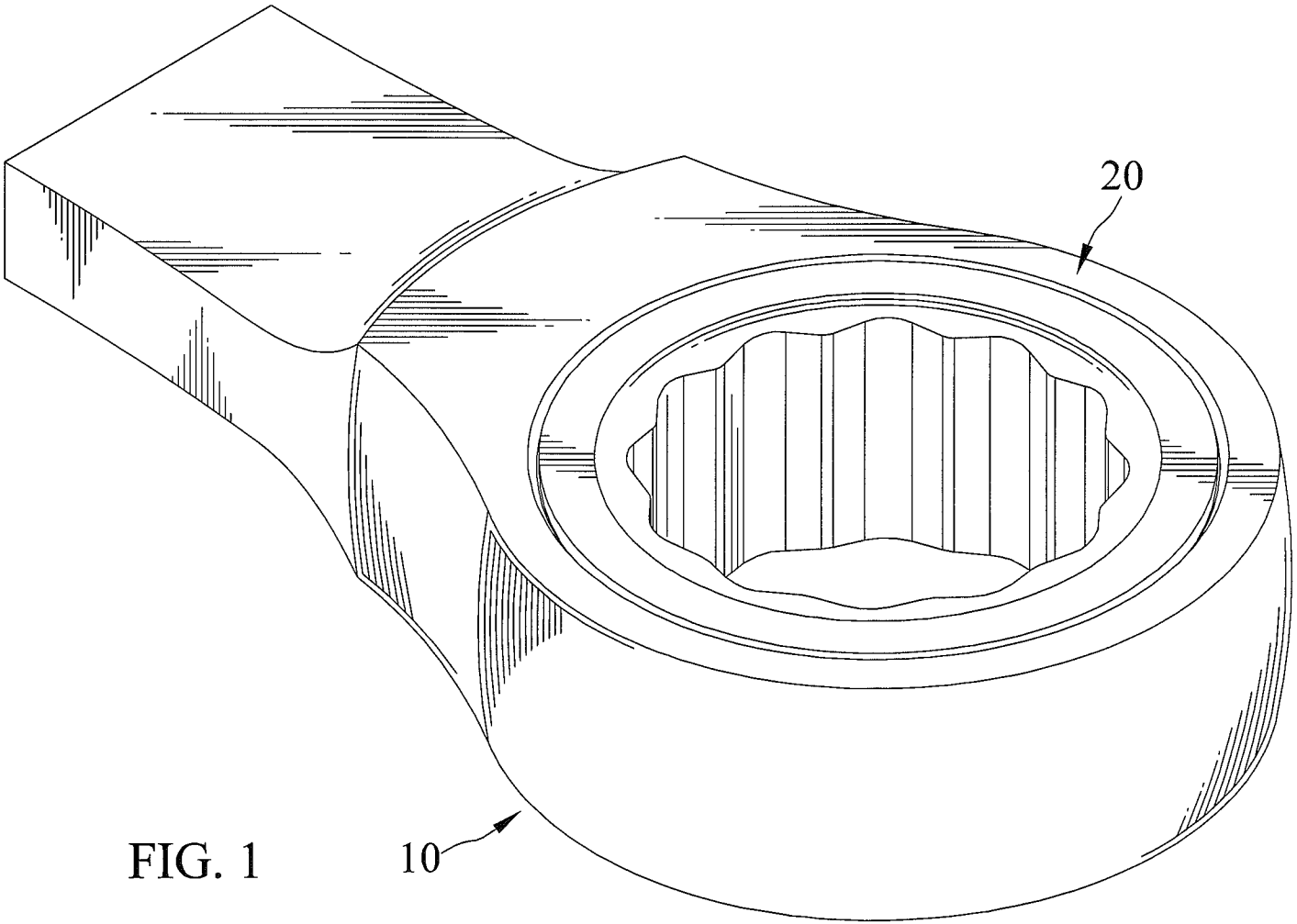
FIG. 1 is a perspective view of a driving end of a ratchet wrench in accordance with a first embodiment of the present invention.
Figure 2:
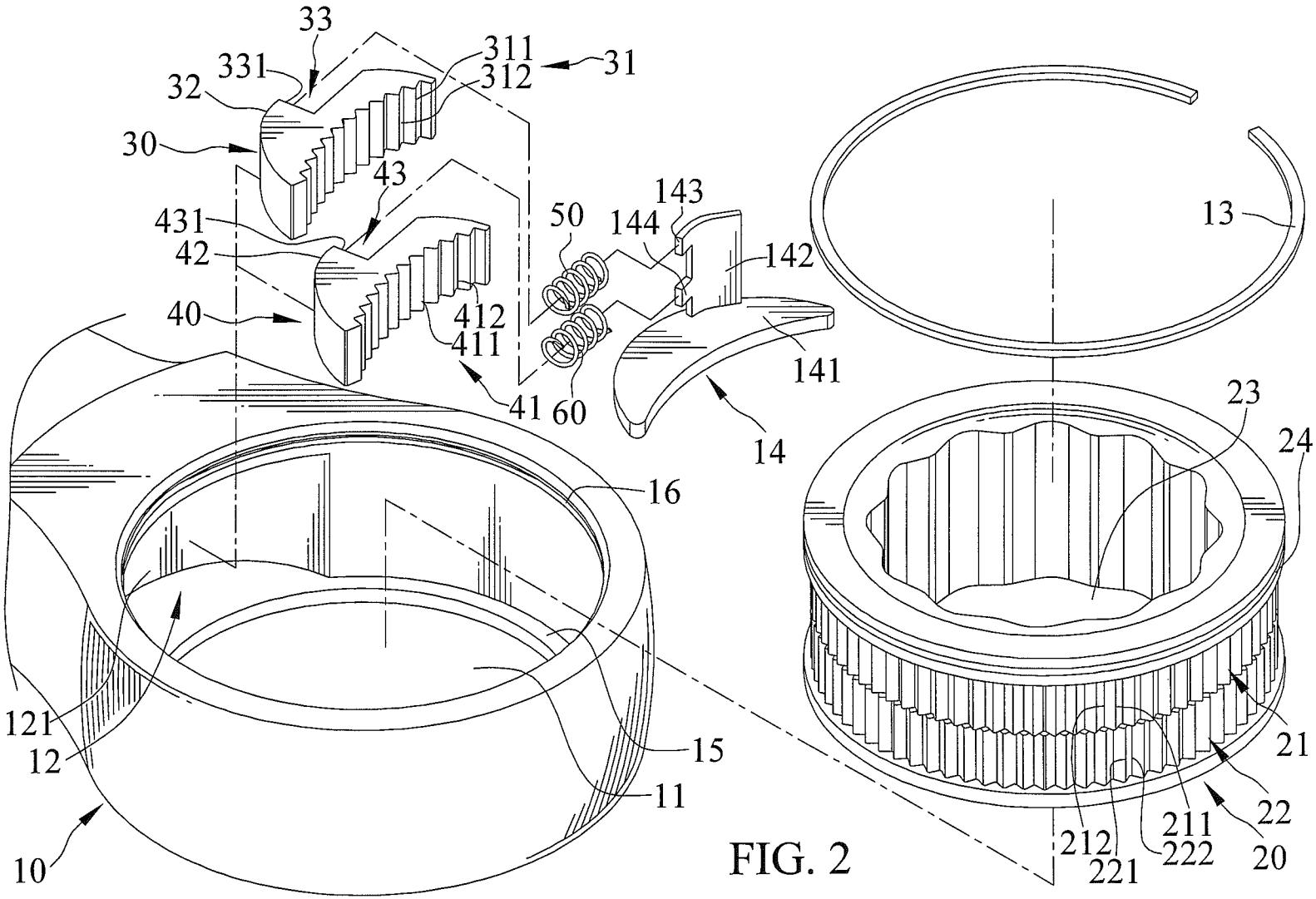
FIG. 2 is an exploded perspective view of FIG. 1.
Figure 3:
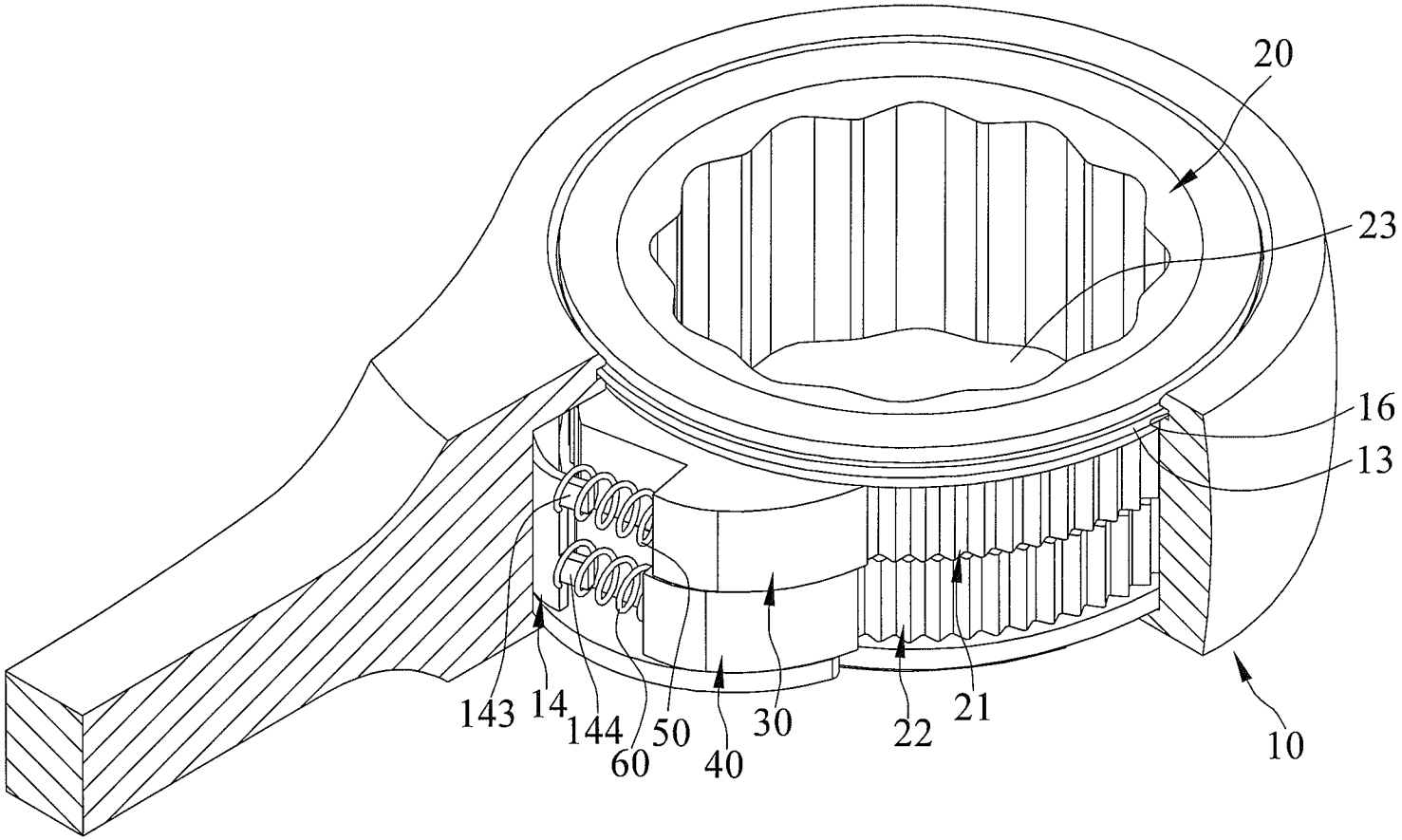
FIG. 3 is a partial cut-out view of FIG. 1.
Figure 4:
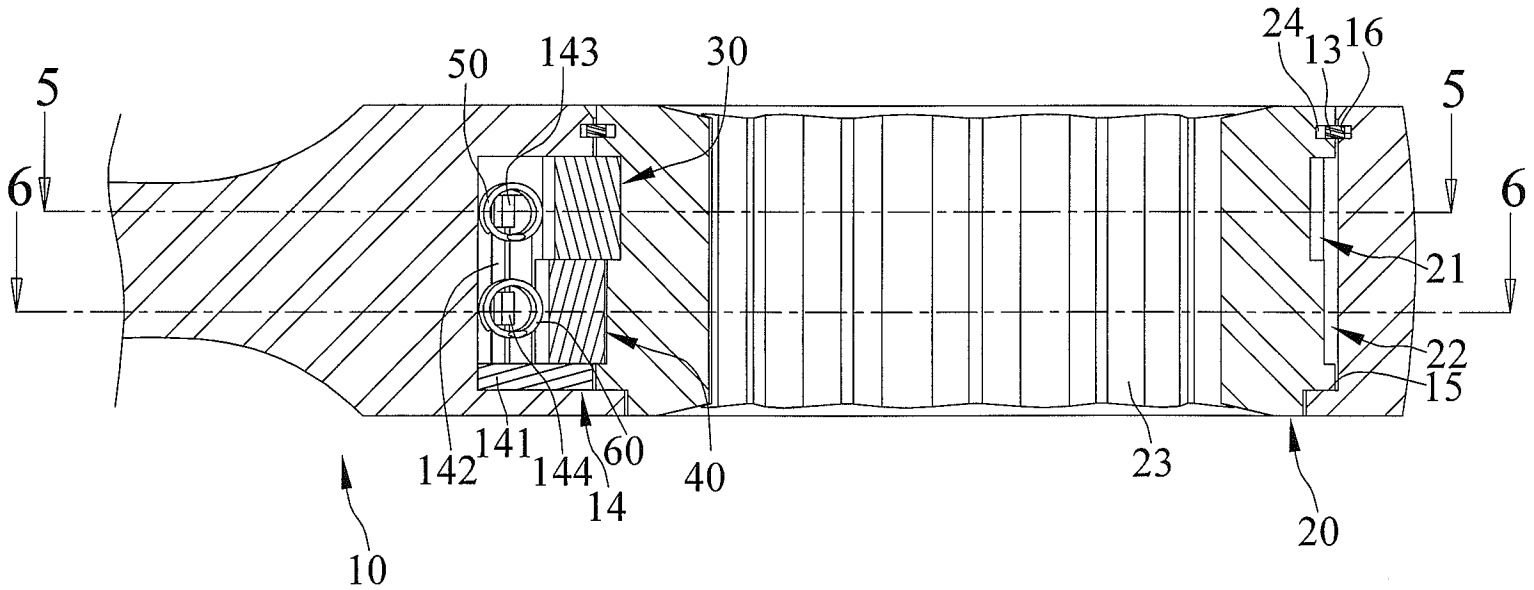
FIG. 4 is a cross-sectional view of FIG. 1.
Figure 5:
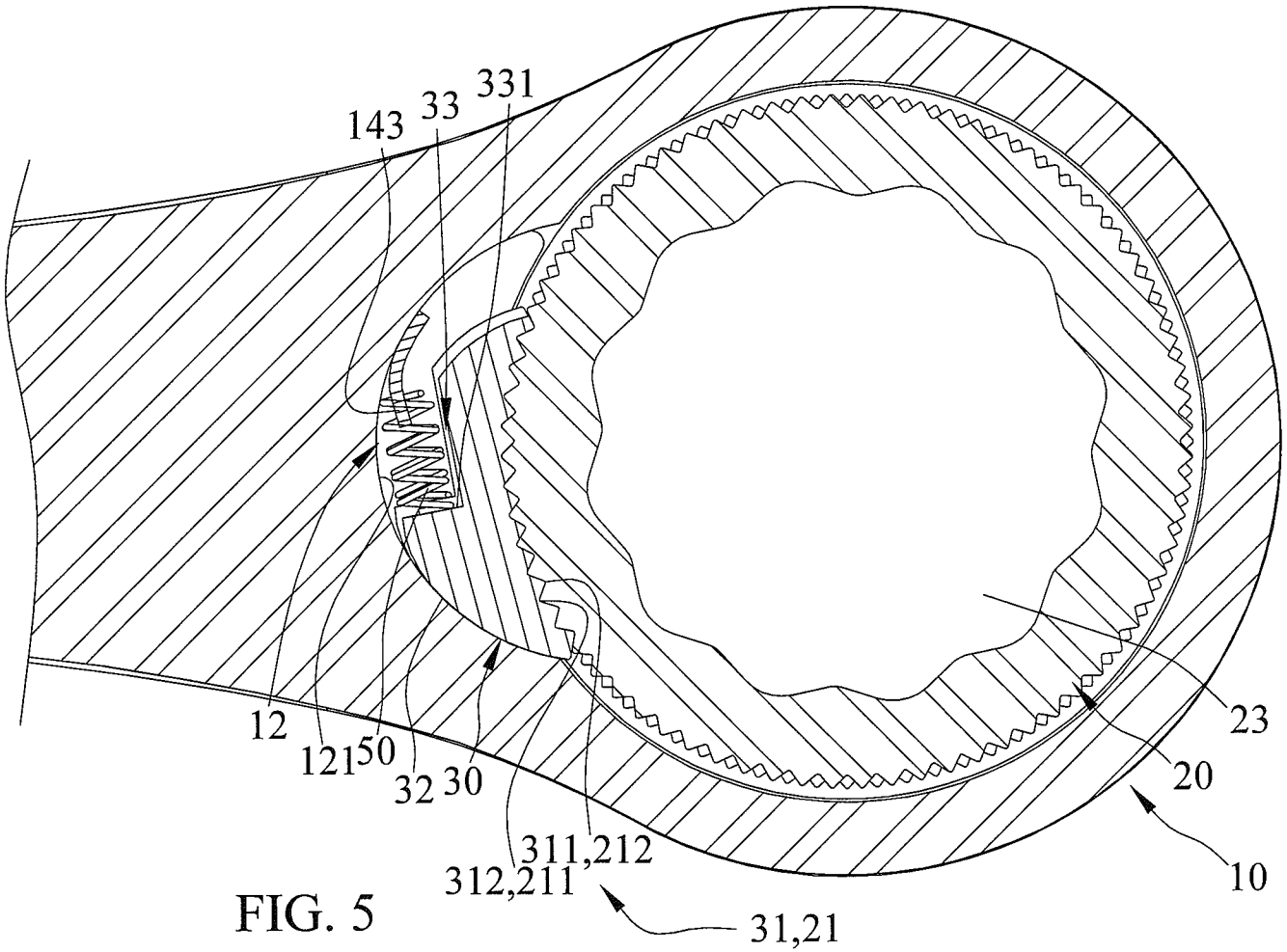
FIG. 5 is a cross-sectional view taken along line 5-5 of FIG. 4.
Figure 6:
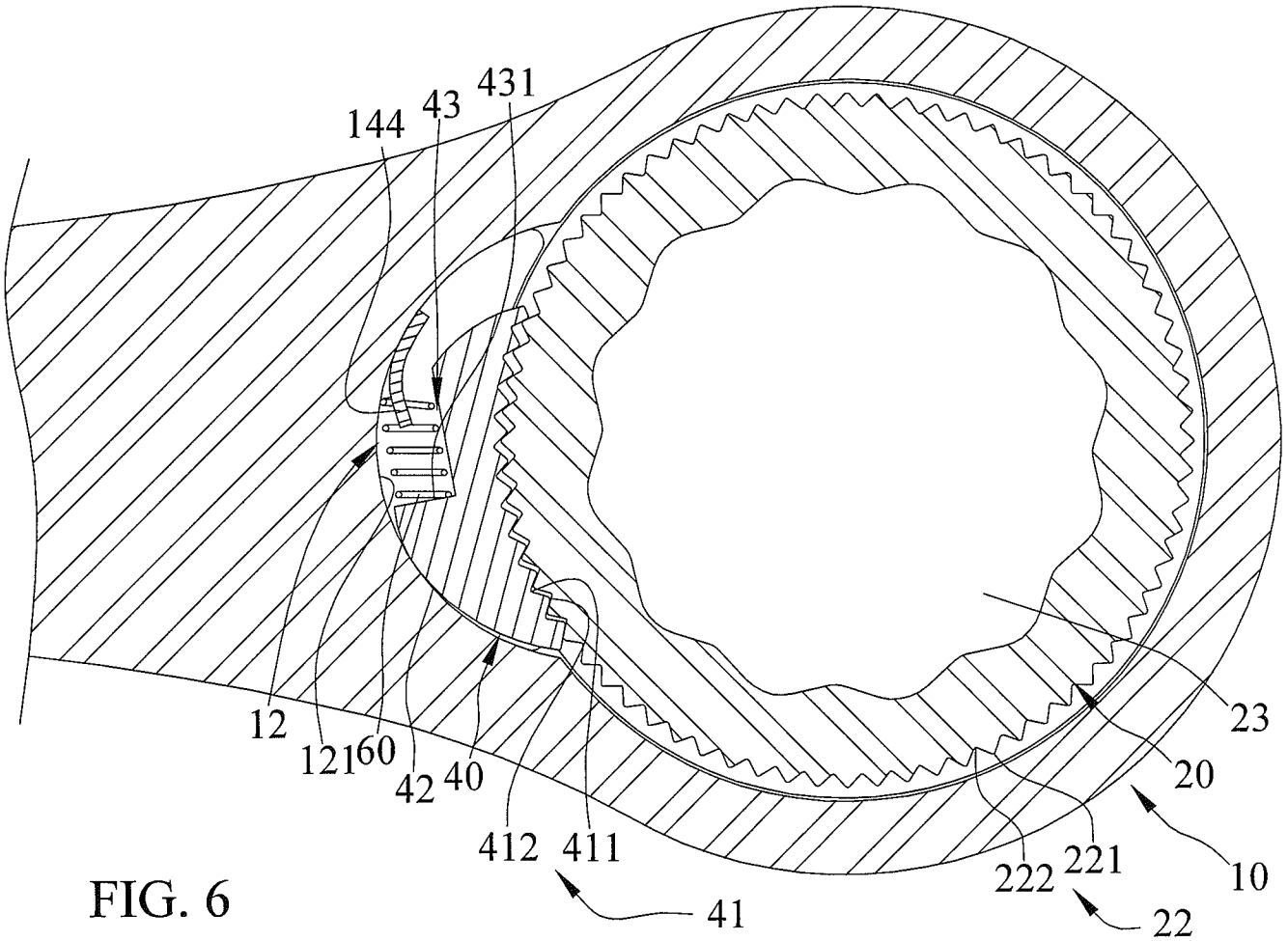
FIG. 6 is a cross-sectional view taken along line 6-6 of FIG. 4.
Figure 7:
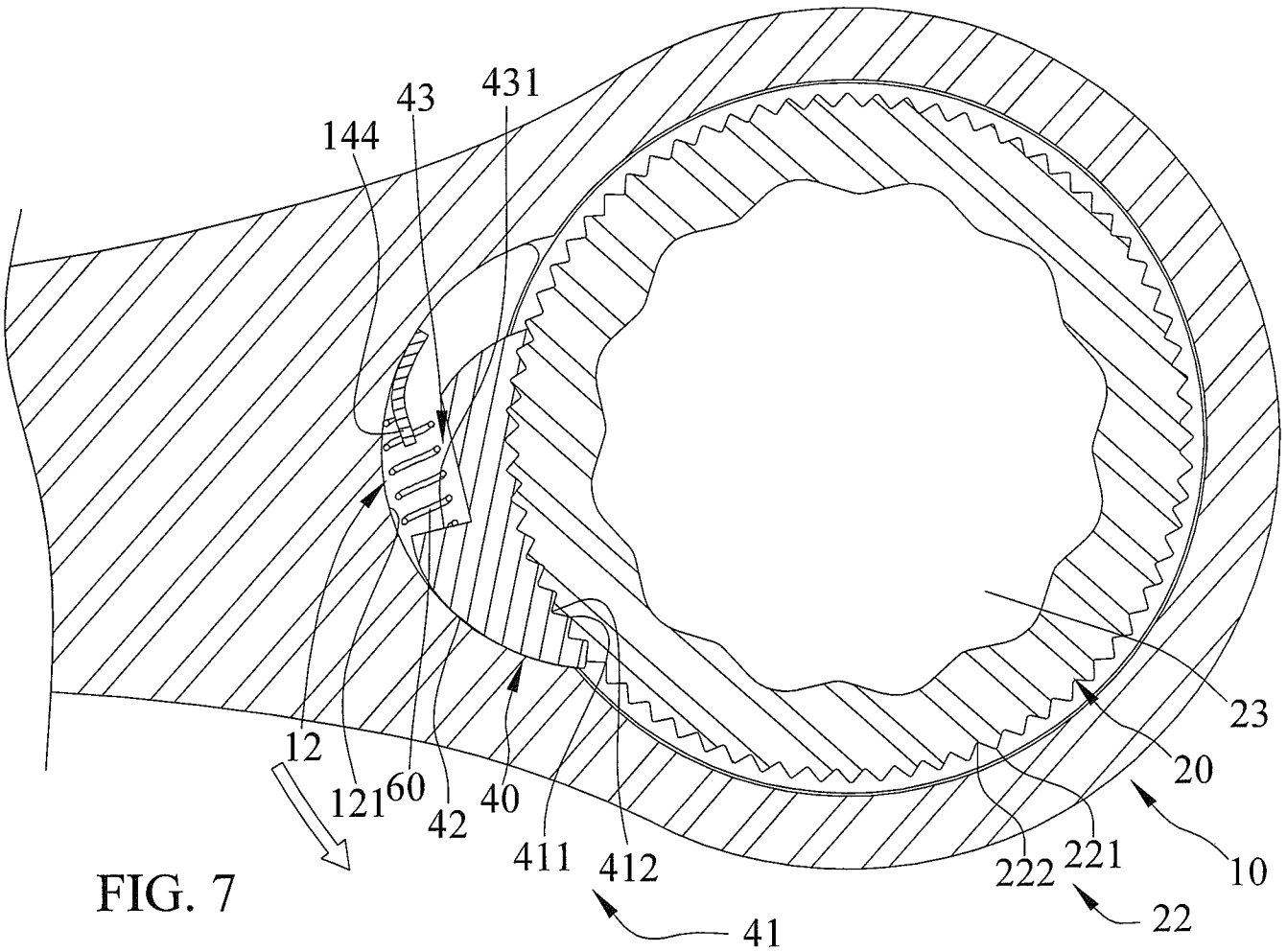
FIG. 7 is a continued view of FIG. 6 and shows the operation of the ratchet wrench in a first operation direction, with the arrow indicating the first operating direction.
Figure 8:
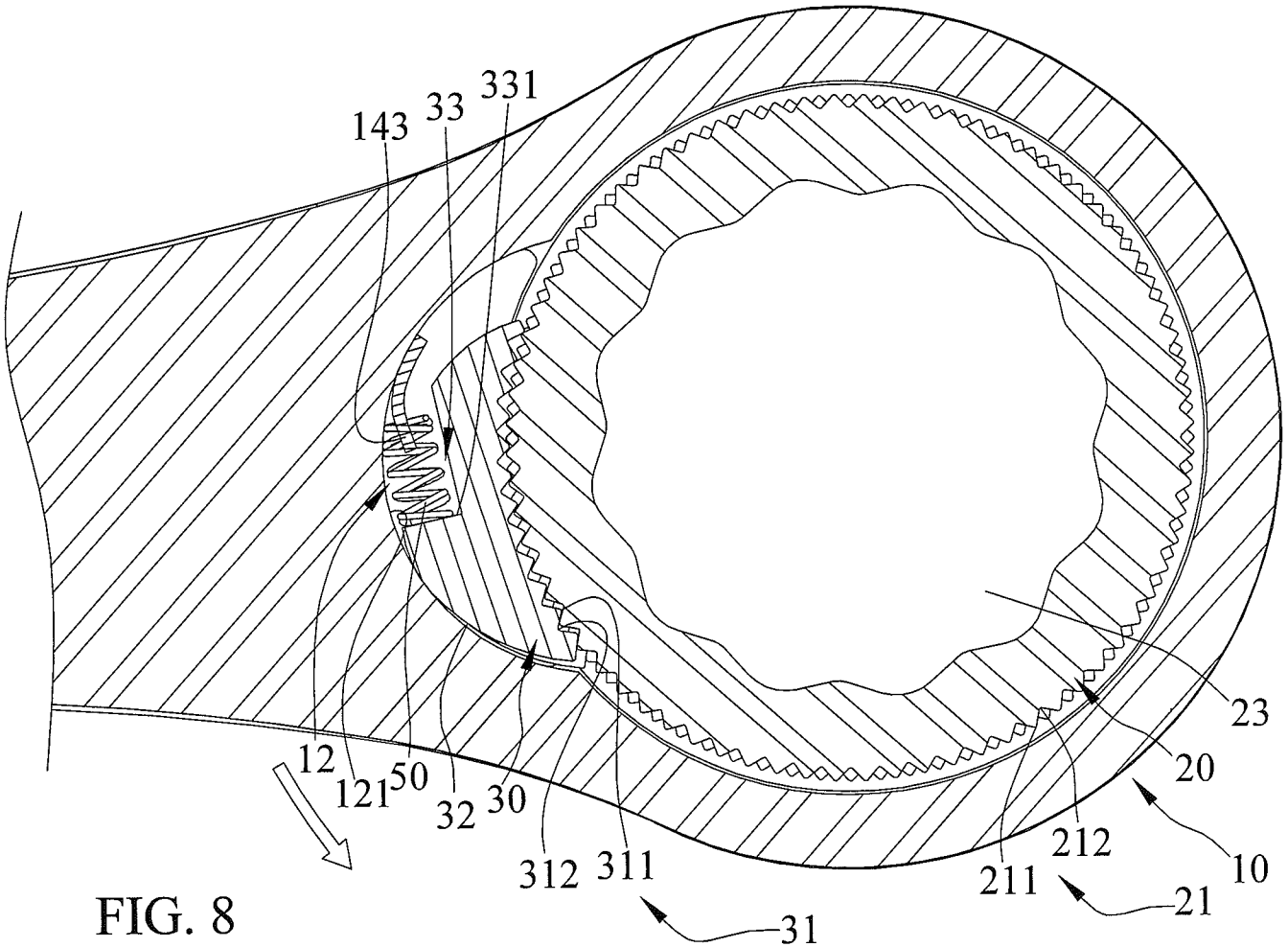
FIG. 8 is a continued view of FIG. 5 and shows the operation of the ratchet wrench in the first operating direction.
Figure 9:
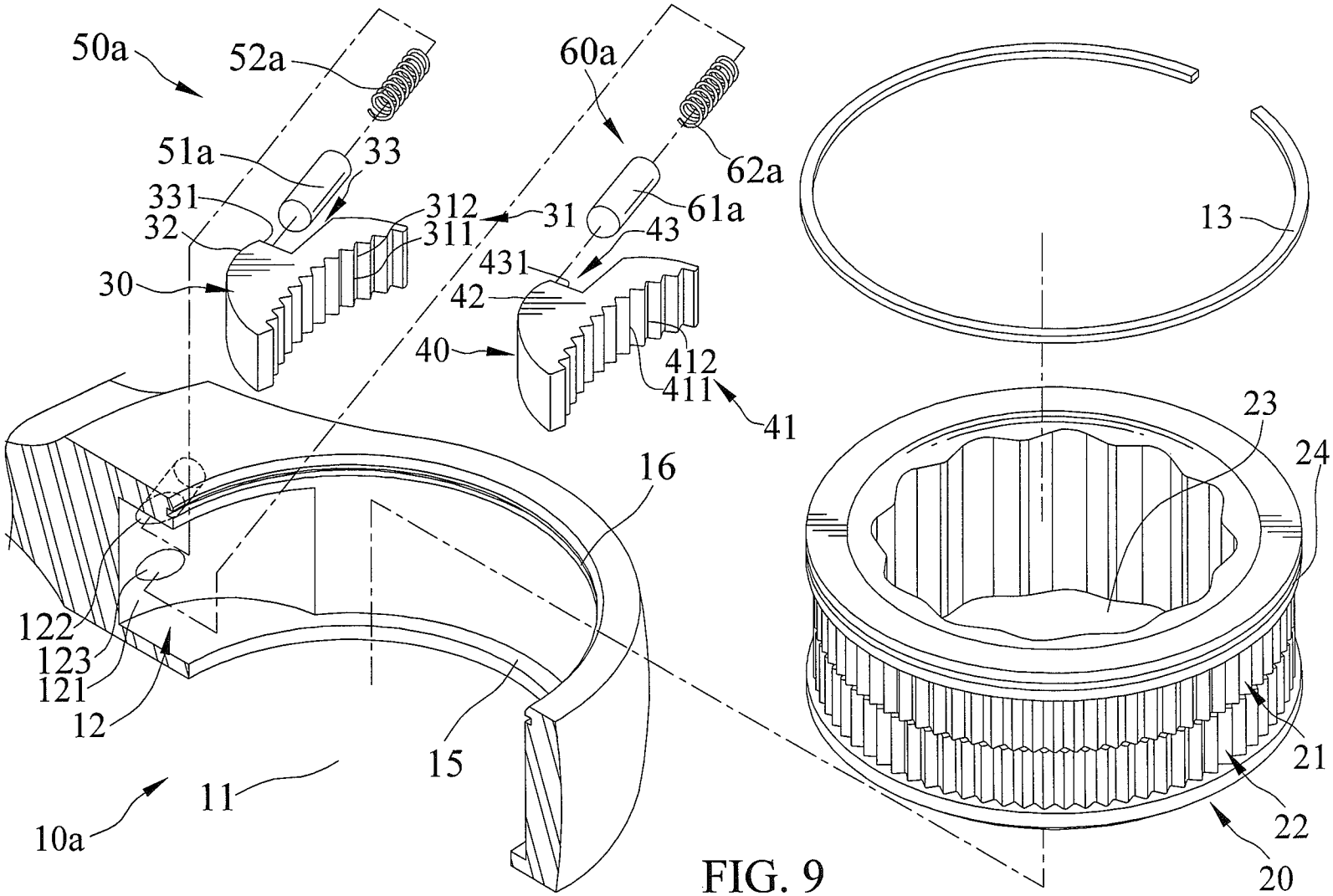
FIG. 9 is an exploded perspective view of a driving end of a ratchet wrench in accordance with a second embodiment of the present invention.
Figure 10:
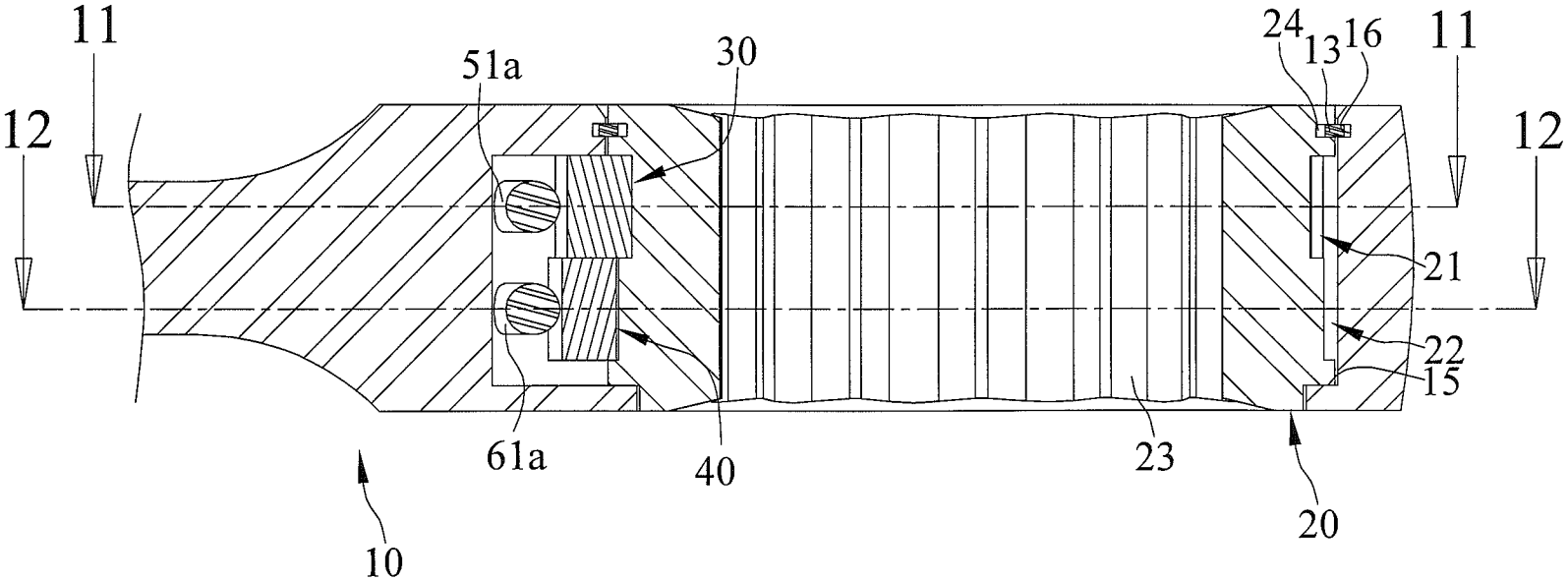
FIG. 10 is a cross-sectional view of FIG. 9.
Figure 11:
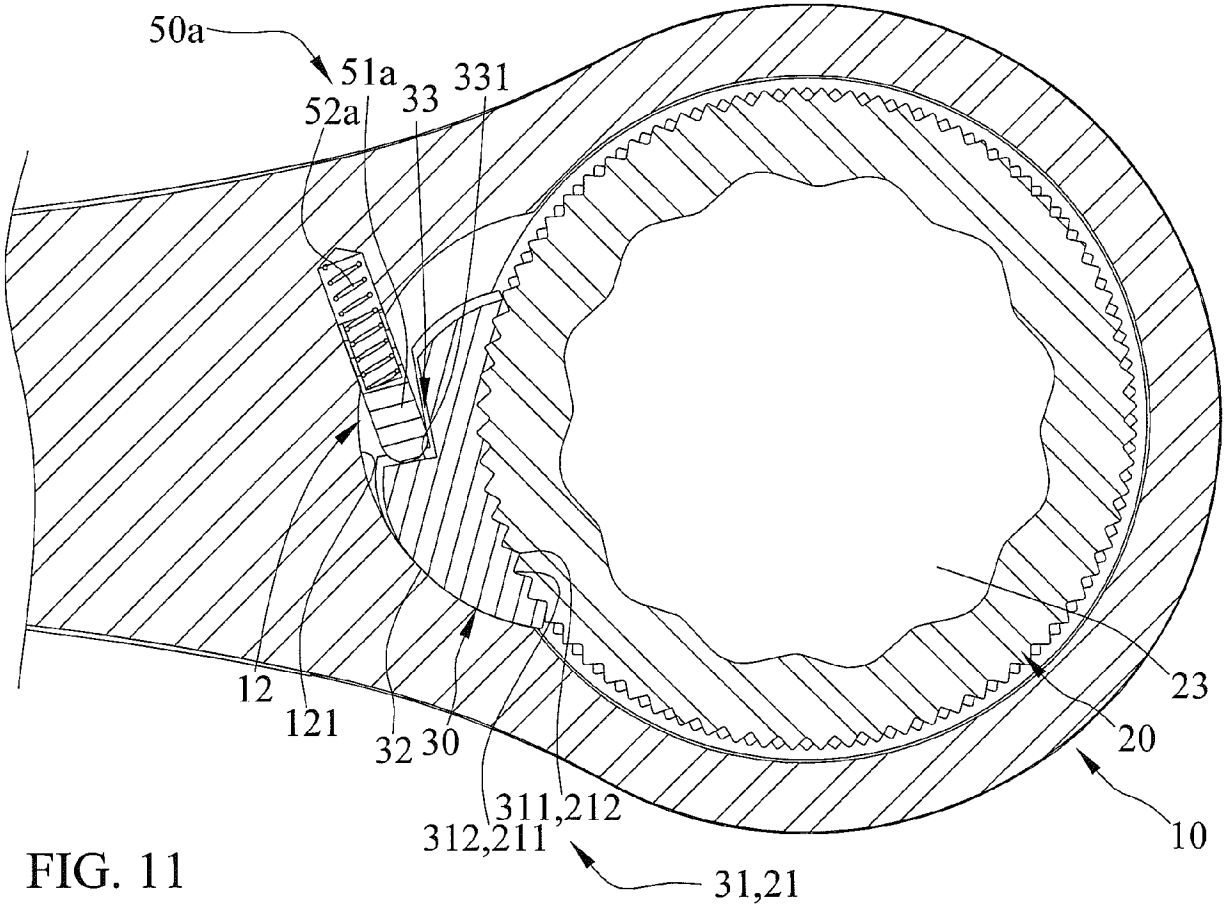
FIG. 11 is a cross-sectional view taken along line 11-11 of FIG. 10.
Figure 12:
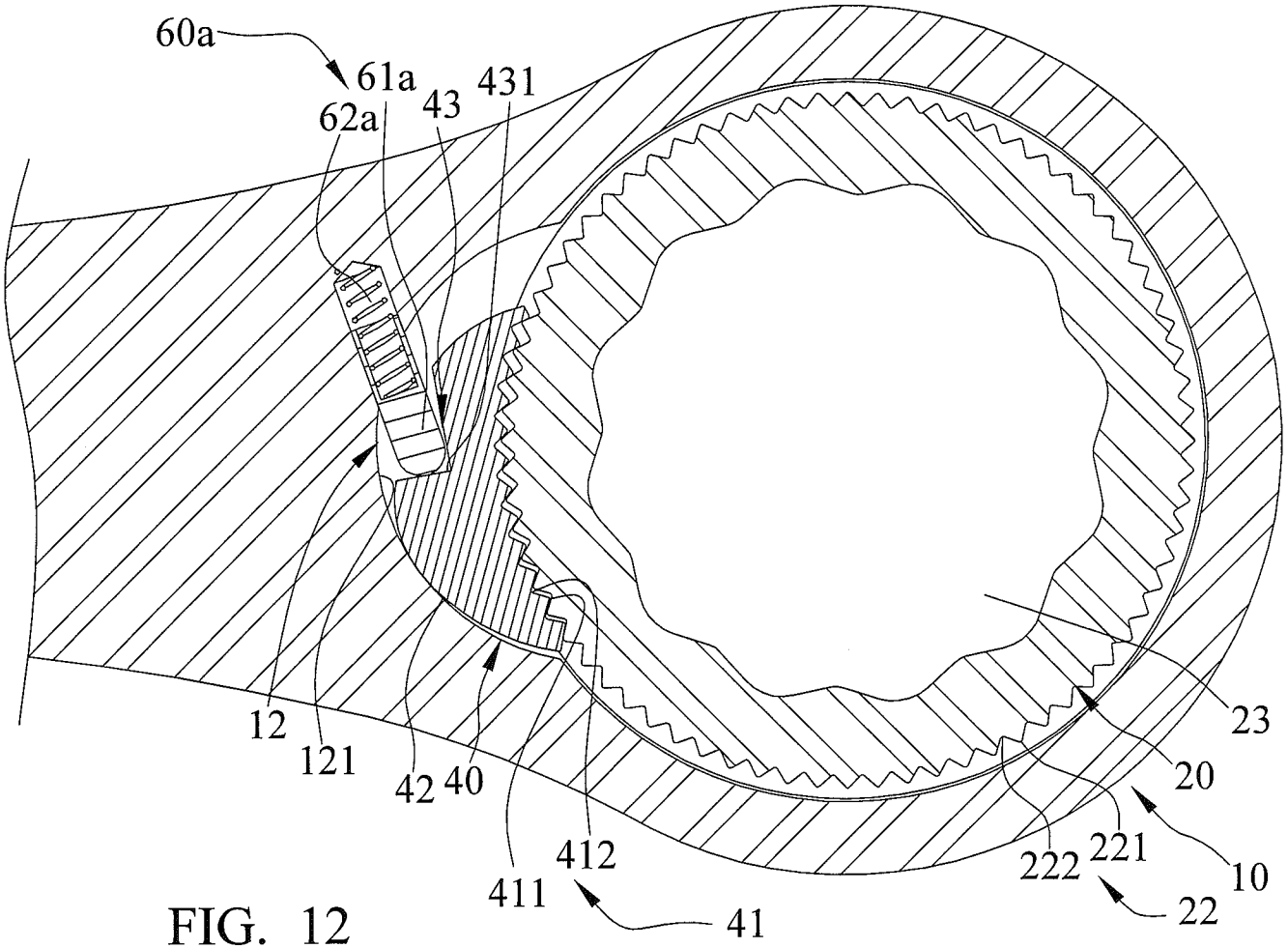
FIG. 12 is a cross-sectional view taken along line 12-12 of FIG. 10.
Figure 13:
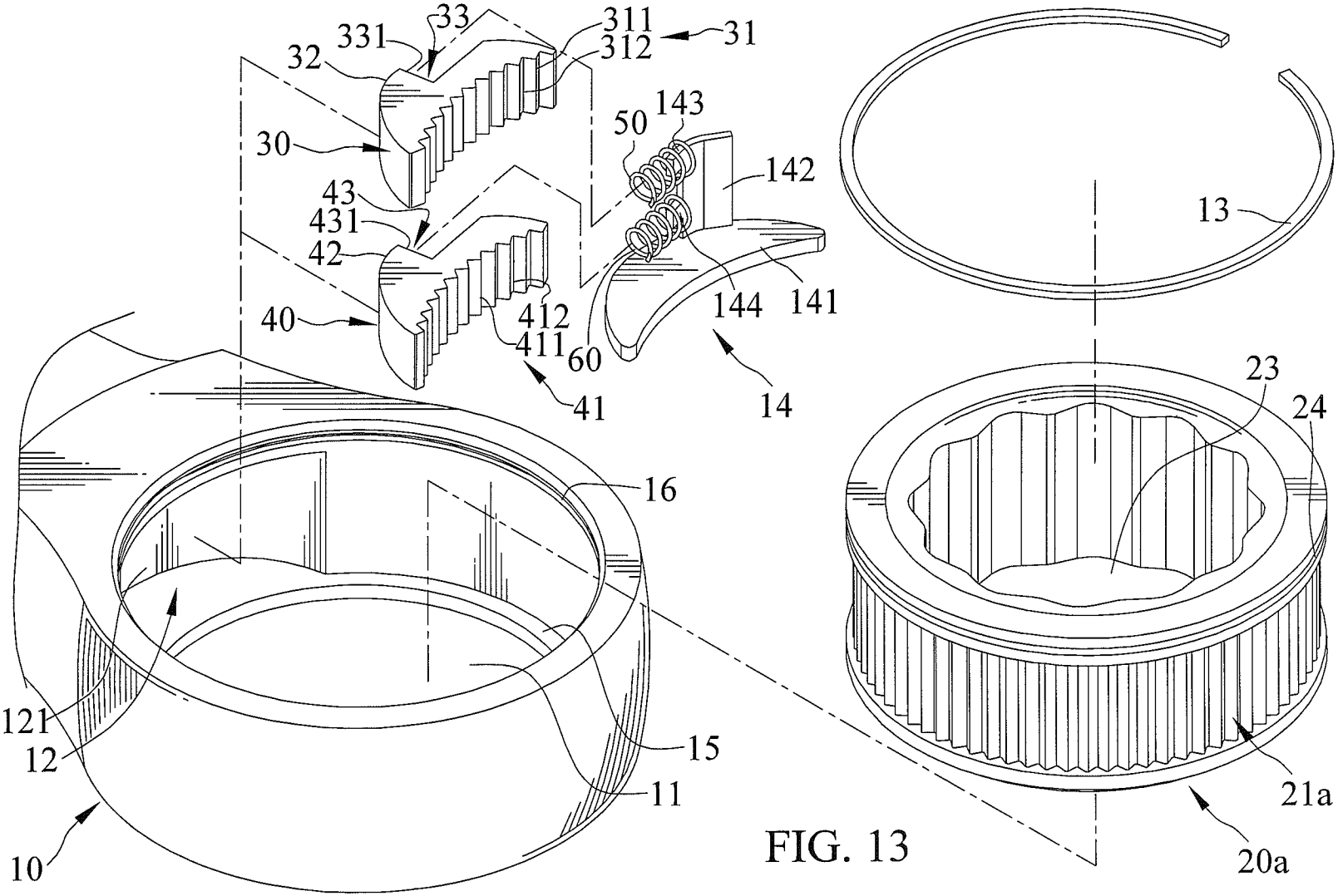
FIG. 13 is an exploded perspective view of a driving end of a ratchet wrench in accordance with a third embodiment of the present invention.
Figure 14:
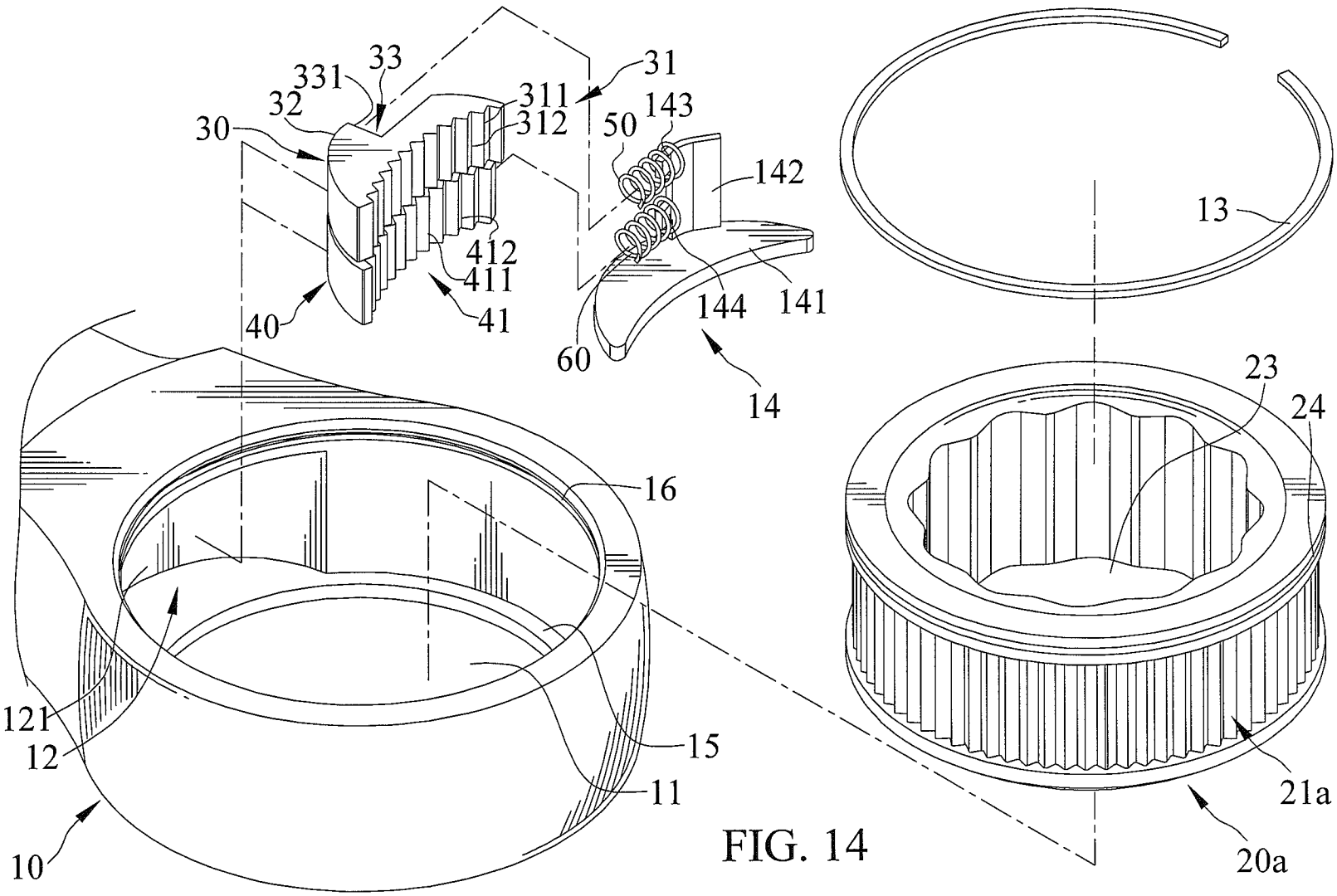
FIG. 14 is another exploded perspective view of the third embodiment.
Figure 15:
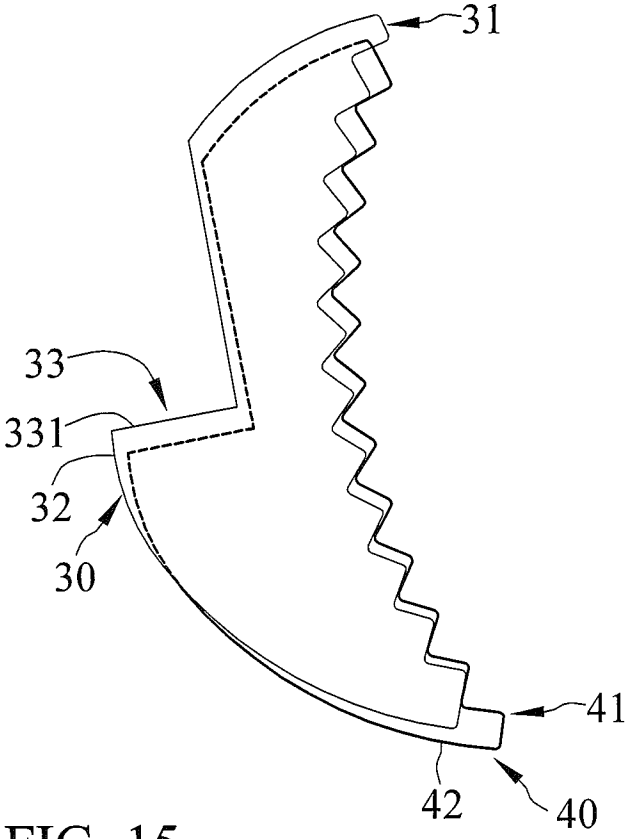
FIG. 15 is a top view showing first and second pawls of the ratchet wrench of FIG. 13 overlapped vertically, with the first pawl offset from the second pawl horizontally.
Figure 16:
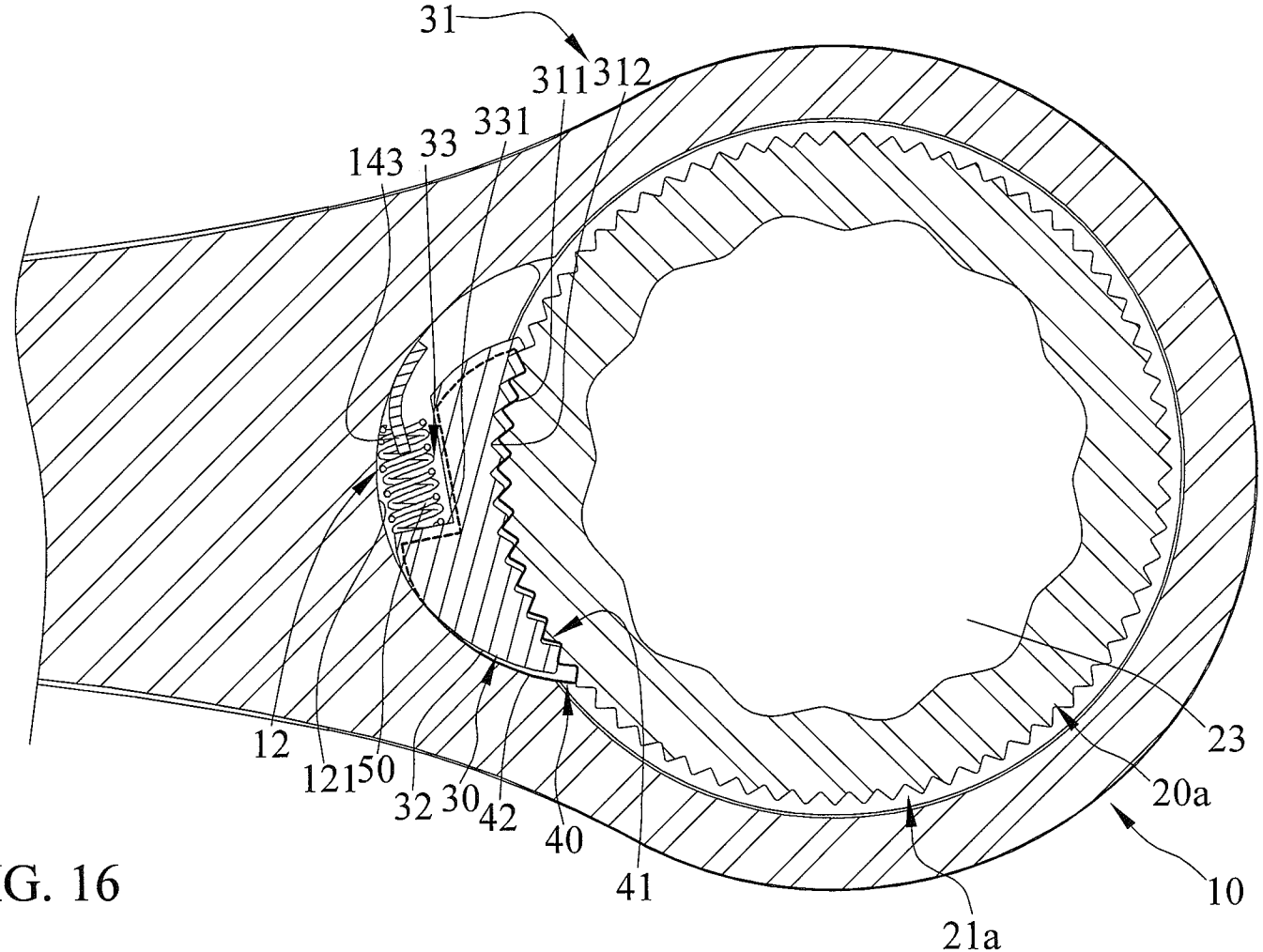
FIG. 16 is a cross-sectional view of the ratchet wrench of FIG. 13 and shows the first and second pawls alternatively engaged with a gear wheel of the ratchet wrench.
Figure 17:
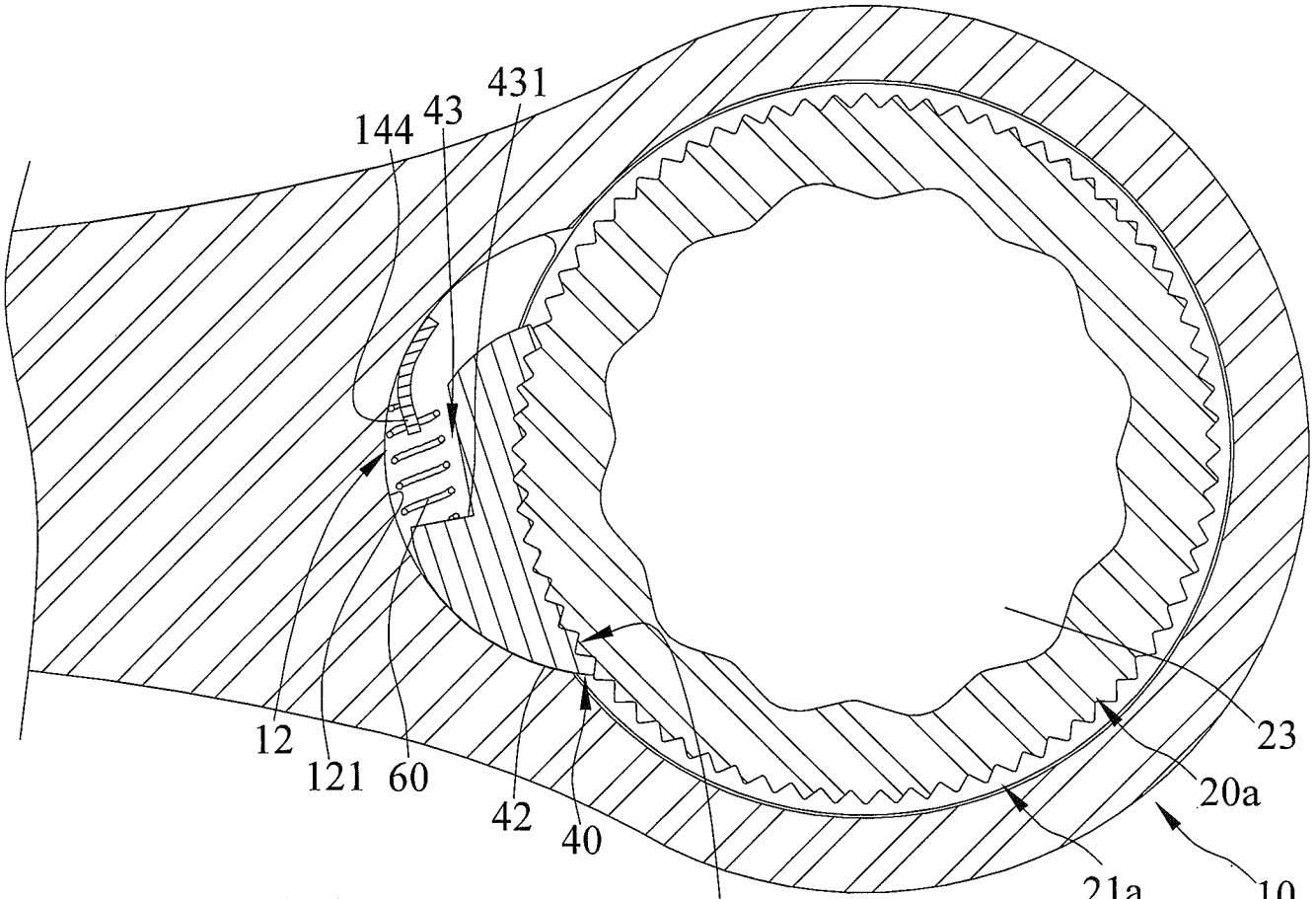
FIG. 17 is an extended cross-sectional view of FIG. 16 showing the second pawl engaged with the gear wheel.

FIGS. 1 through 8 show a ratchet wrench capable of being operated through a relatively smaller minimum swing angle action in accordance with a first embodiment of the present invention. The adjustable wrench includes a head 10. The head 10 includes a chamber defined therein, and a gear wheel 20, a first pawl 30, and a second pawl 40 are disposed in the chamber. The chamber defines first and second compartments 11 and 12. The gear wheel 20 is disposed in the first compartment 11. A flange 15 is extended circumferentially from a wall delimiting the first compartment 11 for bearing the gear wheel 20. A groove 16 is extended circumferentially from the first compartment 11. The gear wheel 20 has an outer periphery thereof including a channel 24 circumferentially inset therein. An annular clip 13 is partially engaged in the groove 16 and partially in the channel 24 to lock the gear wheel 20 to the head 10. The first and second pawls 30 and 40 are disposed in the second compartment 12. The second compartment 12 has an arcuate lateral wall 121.

The gear wheel 20 is adapted to directly engage with an object that is to be driven by the ratchet wrench, with the object engaged in an engaging hole 23. The engaging hole 23 is extended circumferentially, and a wall delimiting the engaging hole 23 includes a plurality of ridges extended therefrom, which improves friction with the object. The gear wheel 20 includes an enclosed annular outer periphery, and includes a plurality of teeth extended circumferentially outwardly therefrom. The plurality of teeth defines first and second plurality of teeth 21 and 22 respectively extended circumferentially outwardly on the outer periphery of the gear wheel 20 at first and second heights. The first plurality of teeth 21 are adjacent to one another. The second plurality of teeth 22 are adjacent to one another. Tooth profiles of each of the first plurality of teeth 21 and each of the second plurality of teeth 22 are the same. The first plurality of teeth 21 are circumferentially offset relative to the second plurality of teeth 22. Each of the first plurality of teeth 21 has a top edge 211, and a bottom edge 222 defining an interconnecting edge of two adjacent teeth of the second plurality of teeth 22 is aligned with the top edge 211. Each of the second plurality of teeth 22 has a top edge 221, and a bottom edge 212 defining an interconnecting edge of two adjacent teeth of the first plurality of teeth 21 is aligned with the top edge 211.

Two pawls of the same shape define the first and second pawls 30 and 40. The first and second pawls 30 and 40 are disposed one above the other. The first pawl 30 is offset from the second pawl 40 horizontally. The first pawl 30 includes a lateral side thereof including a third plurality of teeth 31 extended outwardly therefrom. The second pawl 40 includes a lateral side thereof including a fourth plurality of teeth 41 extended outwardly therefrom. Each of the third plurality of teeth 31 has a top edge 311, and a bottom edge 412 defining an interconnecting edge of two adjacent teeth of the fourth plurality of teeth 41 is aligned with the top edge 311. Each of the fourth plurality of teeth 41 has a top edge 411, and a bottom edge 312 defining an interconnecting edge of two adjacent teeth of the third plurality of teeth 31 is aligned with the top edge 411. The first and second pawls 30 and 40 each include the lateral side thereof forming an arcuate side 32 and 42 slidably abutted against the arcuate lateral wall of the second compartment 12. The first pawl 30 includes the arcuate side 32 opposite the third plurality of teeth 31. The second pawl 40 includes the arcuate side 42 opposite the fourth plurality of teeth 41.

The first and second pawls 30 and 40 are moved and alternatively engage with the gear wheel 20 when it is operably turned, and the first and second pawls 30 and 40 move in an arcuate path. The first and second pawls 30 and 40 selectively engage with and disengage from the first and second plurality of teeth 21 and 22, respectively.

The first and second pawls 30 and 40 are independently biased by first and second biasing mechanisms 50 and 60. Two springs each have a plurality of coaxial coils used as first and second biasing mechanisms 50 and 60. The compartment 12 receives a retaining structure 14 for retaining first and second biasing mechanisms 50 and 60. The retaining structure 14 has first and second retaining ends 143 and 144 extended at different heights. The retaining structure 14 includes the first and second retaining ends 143 and 144 defining two protruded sections extended at different heights. The retaining structure 14 has a base 141 and an extension 142 extended from the base 141. The base 141 has a substantially crescent-shaped lateral contour, which defines an arcuate edge abutted against and conforming to the arcuate lateral wall 121 of the second compartment 12, so the retaining structure 14 is stably disposed in the second compartment 12. The base 141 can be eliminated. The extension 142 can be welded so that it is stably disposed. The extension 142 is extended in a direction substantially perpendicularly from the base 141. The first and second retaining ends 143 and 144 are extended in a direction substantially perpendicularly from the extension 142 and in the same direction, and the extension 142 and the first and second retaining ends 143 and 144 form a substantially F-shaped structure. The first and second biasing mechanisms 50 and 60 each include a first end respectively held on the first and second retaining ends 143 and 144, and a second end respectively abutted against the first and second pawls 30 and 40.

The second ends of the first and second biasing mechanisms 50 and 60 are respectively retained in a recessed area 33 inset on the lateral side of the first pawl 30 and a recessed area 43 inset on the lateral side of the second pawl 40. The recessed area 33 forms an engaging side 331 which is substantially a flat surface and against which the first biasing mechanism 50 abuts. The recessed area 43 forms an engaging side 431 which is substantially a flat surface and against which the second biasing mechanism 60 abuts. The recessed areas 33 and 43 are respectively opposite the third and fourth plurality of teeth 31 and 41.

FIGS. 9 through 12 show a ratchet wrench in accordance with a second embodiment of the present invention. The second embodiment is similar to the first embodiment except a head 10*a* replaces the head 10. The head 10*a* is modified from the head 10 to include two receptacles 122 and 123 extended from the chamber. Additionally, first and second biasing mechanisms 50*a* and 60*a* respectively replace the first and second biasing mechanisms 50 and 60. The first and second biasing mechanisms 50*a* and 60*a* each include a pusher 51*a* and 61*a* and a biasing element 52*a* and 62*a*, and the first and second biasing mechanisms 50*a* and 60*a* include the associated biasing elements 52*a* and 62*a* each having a first end retained in one receptacle 122 or 123 and a second end abutted against the associated pusher 51*a* and 61*a*. The first and second biasing mechanisms 50*a* and 60*a* also include the associated pusher 51*a* and 61*a* respectively abutted against the first and second pawls 30 and 40.

FIGS. 13 through 17 show a ratchet wrench in accordance with a third embodiment of the present invention. The third embodiment is similar to the first embodiment except a gear wheel 20*a* replaces the gear wheel 20. The gear wheel 20*a* is modified from the gear wheel 20 to eliminate the second plurality of teeth 22 and to make each of the first plurality of teeth 21 have a longer longitudinal length. The modified first plurality of teeth is numbered as 21*a*.

Figure 18:
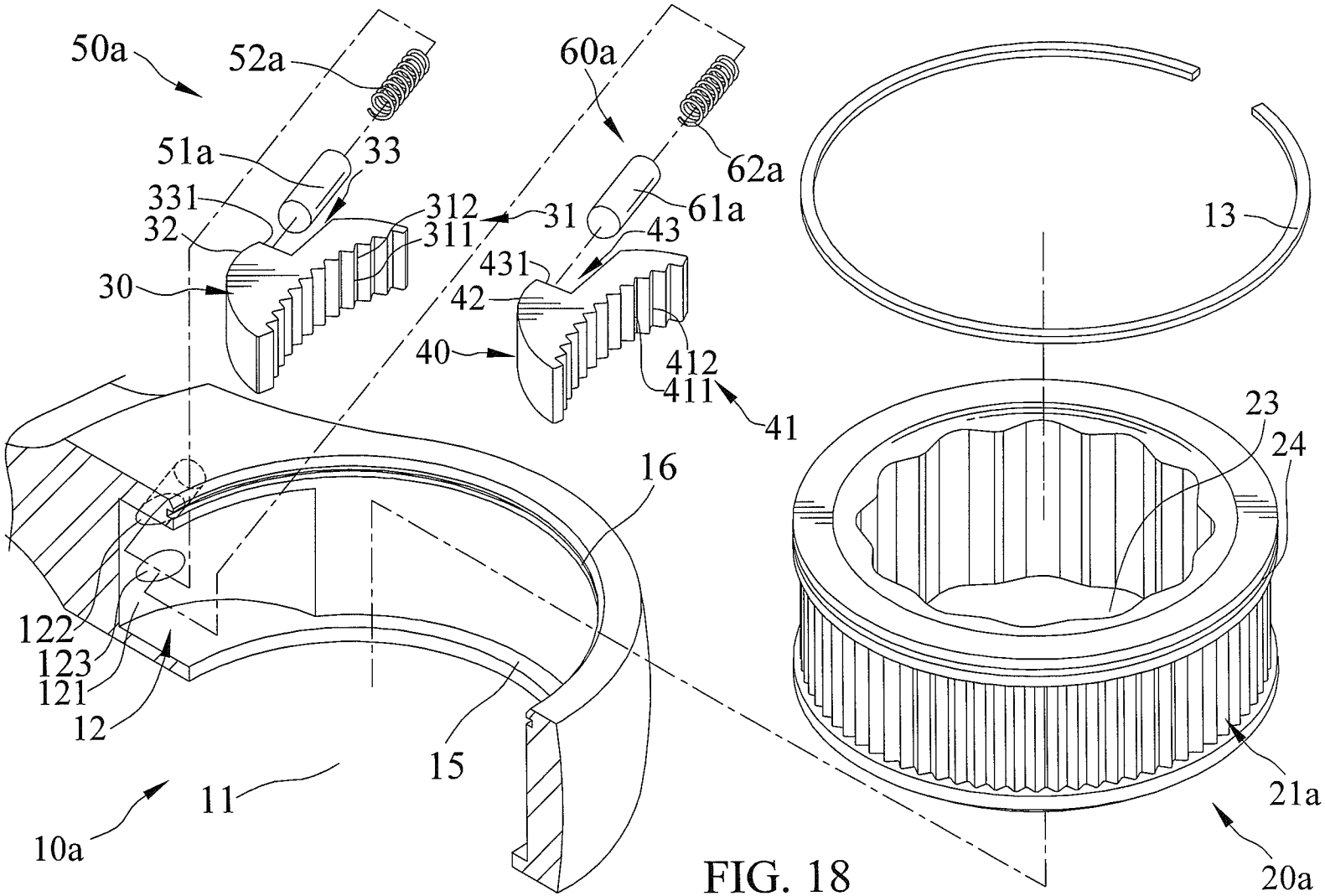
FIG. 18 is an exploded perspective view of a driving end of a ratchet wrench in accordance with a fourth embodiment of the present invention.

FIG. 18 shows a ratchet wrench in accordance with a fourth embodiment of the present invention. The fourth embodiment is similar to the second embodiment except the gear wheel 20*a* in the third embodiment replaces the gear wheel 20.

In view of the forgoing, the first plurality of teeth 21 is circumferentially offset relative to the second plurality of teeth 22, or the first pawl 30 is horizontally offset relative to the second pawl 40 in order to make the first and second pawls 30 and 40 alternatively engage with the gear wheel 20, 20*a* when it is operably turned, and to make the ratchet wrench have a relatively smaller minimum swing angle action without reducing each of the first, second, third, and fourth plurality of teeth 21, 22, 31 and 32 to a size that is liable to become damaged easily when subject to a larger torque transmission.

While the specific embodiments have been illustrated and described, numerous modifications come to mind without significantly departing from the spirit of invention, and the scope of invention is only limited by the scope of the accompanying claims.

What is claimed is:

1. A ratchet wrench capable of being operated through a relatively smaller minimum swing angle act ion, comprising:

a head forming a chamber having an arcuate lateral wall; and a gear wheel, a first pawl, and a second pawl disposed in the chamber defined in the head, wherein the gear wheel has an outer periphery thereof including a plurality of teeth extended circumferentially outwardly therefrom, wherein the first pawl includes a plurality of teeth and an arcuate side slideably abutted against the arcuate lateral wall, wherein the second pawl includes a plurality of teeth and an arcuate side slidably abutted against the arcuate lateral wall wherein the first and second pawls are disposed one above the other, wherein the first and second pawls are respectively biased by first and second biasing mechanisms, wherein the first and second pawls independently move in an arcuate path when operably turned, and wherein the first and second pawls are alternatively engaged with the gear wheel when operably turned;

wherein the chamber receives a retaining structure for retaining the first and second biasing mechanisms, wherein the retaining structure has first and second retaining ends extended at different heights, and wherein the first and second biasing mechanisms each include a first end respectively held on the first and second retaining ends, and a second end respectively abutted against the first and second pawls.

2. The ratchet wrench as claimed in claim 1, wherein the retaining structure has an extension, and wherein the first and second retaining ends are extended in a direction substantially perpendicularly from the extension and in the same direction.

3. The ratchet wrench as claimed in claim 2, wherein the retaining structure has a base, wherein the extension is extended from the base, wherein the extension is extended in a direction substantially perpendicularly from the base, and wherein the first and second retaining ends are parallel to and spaced from the base.

4. The ratchet wrench as claimed in claim 1, wherein two receptacles are extended from the chamber generally tangentially to the outer periphery of the gear wheel, wherein the first and second biasing mechanisms each include a pusher and a biasing element, wherein the first and second biasing mechanisms include the associated biasing elements each having a first end retained in one receptacle and a second end abutted against the associated pusher, and wherein the first and second biasing mechanisms include the associated pusher respectively abutted against the first and second pawls.

5. The ratchet wrench as claimed in claim 4, wherein a groove is extended circumferentially from the chamber in the head, wherein the gear wheel has the outer periphery thereof including a channel circumferentially inset therein, and wherein an annular clip is partially engaged in the groove and partially in the channel.

6. The ratchet wrench as claimed in claim 4, wherein the plurality of teeth of the gear wheel define first and second plurality of teeth respectively extended circumferentially outwardly therefrom, and wherein the first plurality of teeth are circumferentially offset relative to the second plurality of teeth.

7. The ratchet wrench as claimed in claim 6, wherein each of the first plurality of teeth has a first top edge, wherein a bottom edge defining an interconnecting edge of two adjacent teeth of the second plurality of teeth is aligned with the first top edge, wherein each of the second plurality of teeth has a second top edge, wherein a bottom edge defining an interconnecting edge of two adjacent teeth of the first plurality of teeth is aligned with the second top edge, wherein each of the plurality of teeth of the first pawl has a third top edge, wherein a bottom edge defining an interconnecting edge of two adjacent teeth of the plurality of teeth of the second pawl is aligned with the third top edge, and wherein each of the plurality of teeth of the second pawl has a fourth top edge, and wherein a bottom edge defining an interconnecting edge of two adjacent teeth of the plurality of teeth of the first pawl is aligned with the fourth top edge.

8. The ratchet wrench as claimed in claim 1, wherein a groove is extended circumferentially from the chamber in the head, wherein the gear wheel has the outer periphery thereof including a channel circumferentially inset therein, and wherein an annular clip is partially engaged in the groove and partially in the channel.

9. The ratchet wrench as claimed in claim 1, wherein the plurality of teeth of the gear wheel define first and second plurality of teeth respectively extended circumferentially outwardly therefrom, and wherein the first plurality of teeth are circumferentially offset relative to the second plurality of teeth.

10. The ratchet wrench as claimed in claim 9, wherein each of the first plurality of teeth has a first top edge, wherein a bottom edge defining an interconnecting edge of two adjacent teeth of the second plurality of teeth is aligned with the first top edge, wherein each of the second plurality of teeth has a second top edge, wherein a bottom edge defining an interconnecting edge of two adjacent teeth of the first plurality of teeth is aligned with the second top edge, wherein each of the plurality of teeth of the first pawl has a third top edge, wherein a bottom edge defining an interconnecting edge of two adjacent teeth of the plurality of teeth of the second pawl is aligned with the third top edge, and wherein each of the plurality of teeth of the second pawl has a fourth top edge, and wherein a bottom edge defining an interconnecting edge of two adjacent teeth of the plurality of teeth of the first pawl is aligned with the fourth top edge.

* * * * *